US005533768A

United States Patent [19]

Mitchell

[11] Patent Number: 5,533,768

[45] Date of Patent: Jul. 9, 1996

[54] ERGONOMIC SHOVEL

[76] Inventor: David Mitchell, 7948 Foucher, Montreal, Quebec, Canada, H2R 2L1

[21] Appl. No.: 304,937

[22] Filed: Sep. 13, 1994

[51] Int. Cl.[6] ..... B25G 1/02; E01H 5/02

[52] U.S. Cl. ..... 294/54.5; 294/57

[58] Field of Search ..... 294/49, 54.5, 57; 15/143.1; 16/110 R, 111 R, DIG. 24; 37/264, 265, 285

[56] References Cited

U.S. PATENT DOCUMENTS

| | | | |
|---|---|---|---|
| 470,122 | 3/1892 | Hammer . | |
| 645,988 | 3/1900 | Willard . | |
| 1,177,072 | 3/1916 | Warman . | |
| 1,177,073 | 3/1916 | Warman . | |
| 1,267,915 | 5/1918 | Shellabarger . | |
| 1,930,000 | 10/1933 | Bulger . | |
| 2,047,485 | 7/1936 | McBrady . | |
| 2,664,582 | 1/1954 | Kammann | 15/143.1 |
| 3,401,971 | 9/1968 | Cronquist . | |
| 3,804,451 | 4/1974 | Burke | 294/54.5 |
| 4,550,943 | 11/1985 | Mirto . | |
| 4,691,954 | 9/1987 | Shaud . | |
| 4,720,206 | 1/1988 | Aquilina . | |
| 4,730,860 | 3/1988 | Padgett . | |
| 4,783,105 | 11/1988 | Schulz | 294/57 |
| 4,785,489 | 11/1988 | Von Doehren | 15/143.1 |

*Primary Examiner*—Dean Kramer
*Attorney, Agent, or Firm*—Robic

[57] ABSTRACT

A shovelling tool has a flexible portion at the base of the handle that helps prevent the risk of injury when shovelling by absorbing the initial shock when digging or by adjusting gradually to a different load when shovelling. This tool, which is preferably telescopic, is particularly useful for removing snow and ice.

7 Claims, 12 Drawing Sheets

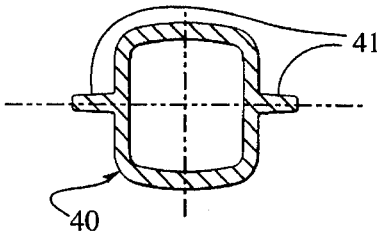
Fig.4
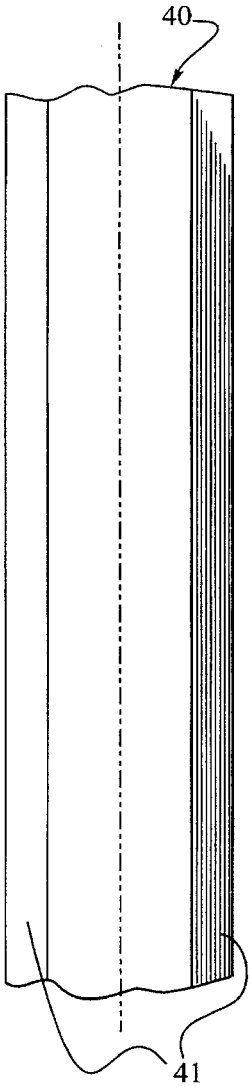
Fig.5
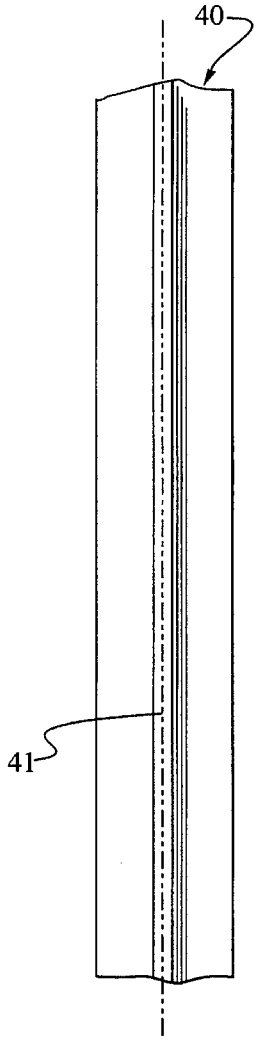
Fig.6
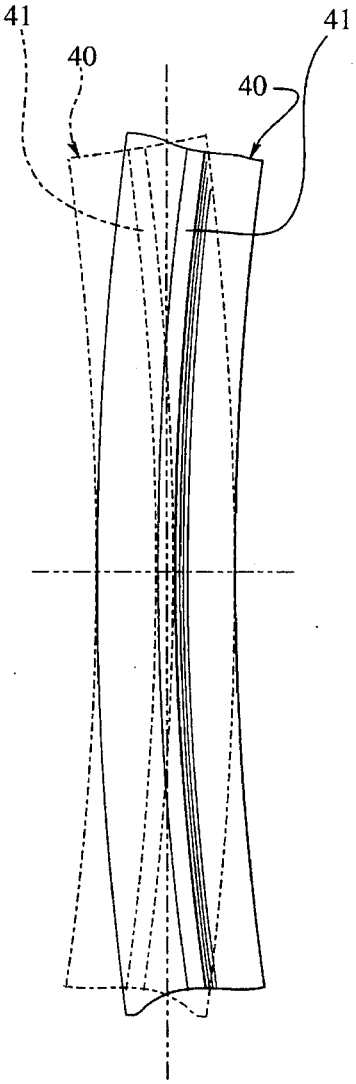
Fig.7
Fig.8
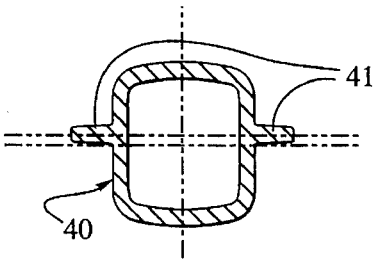

ERGONOMIC SHOVEL

BACKGROUND OF THE INVENTION a) Field of the Invention

The present invention relates to a hand tool for the shovelling of debris, particularly snow and ice, having a flexible portion along its handle so as to permit limited flexion of the handle when lifting a load.

The invention also relates to a hand tool as described above, where the handle is collapsible or retractable.

b) Description of prior art

Hitherto, it has been common to mount a blade on a handle to form a tool which may be used for shovelling.

U.S. Pat. Nos. 1,177,072, 1,177,073, 1,267,915, 1,930,000, 2,047,485, 3,401,971 relate to shovels which have collapsible or retractable handles of various designs.

U.S. Pat. No. 4,730,860 relates to a shovel having a vibrator mounted between the handle and the blade so as to increase its digging efficiency.

U.S. Pat. No. 4,691,954 relates to a snow shovel having a telescoping handle and a detachable blade. A compression spring extends lengthwise within the handle. This spring is mounted so as to compress under load or shock from striking an object submerged in the snow. When the shovel is lifted, the spring decompresses and assists in discharging the load.

In the snow remover art, U.S. Pat. 4,550,943 relates to a snow remover with a collapsible handle.

In the broom art, U.S. Pat. No. 645,988 relates to a handle which has a slit lengthwise along it whereby the handle absorbs the initial shock when sweeping.

It is recognized that one of the problems associated with such devices is that they are associated with back pains due to the stiffness of the handle. Indeed, because of such stiffness, the user of the shovel has to absorb all the force fluctuations associated with lifting a load and discharging it. Particularly, when the user lifts a load with a given force and this load is greater than anticipated, he or she does not have the opportunity to adjust to the new load gradually and thus risks injury when lifting a load of unknown weight.

OBJECTS OF THE INVENTION

It is apparent from the foregoing that it is desirable to have a shovel where a portion of the handle can flex in a limited manner in a plane perpendicular to the front edge of the shovel exclusively, such that the handle absorbs part of the initial shock and permits the user to gradually adjust the force required to lift the load.

An object of the present invention is to provide such a hand tool having a flexible portion to help prevent the risk of injury. Another object of the invention is also to provide a shovel of the above mentioned type which has a telescopic handle to permit easy and compact storage.

SUMMARY OF THE INVENTION

In meeting this and other objects, the present invention provides a shovel comprising:

a blade having a front edge and a rear portion;

a handle having a front surface and a back surface and two opposite ends, one the ends being fastened to the rear portion of the blade, where the handle has a portion adjacent to the blade which is made flexible so as to permit flexion of the handle to a given extent exclusively in a plane perpendicular to the front edge of the blade.

In use, when a user lifts a load with a given force and the load is greater than anticipated, the flexible portion will permit the user to adjust the force required to lift the load, thereby permitting the user to adjust smoothly to a new load and help prevent the risk of injury when lifting a load of unknown weight.

Furthermore, the flexible portion aids in discharging the load by providing a catapult-like effect when it resumes its static position.

The flexible portion of the handle may consists of either a hollow piece of resilient plastic material having fins extending longitudinally along its side, or of a piece of resilient plastic material having recesses opening on the back surface of the handle and in which are inserted pieces of elastomer. A slidable sleeve may be mounted over such piece and the handle so that the user can adjust the amount of resiliency of the flexible portion.

Furthermore, the handle can be made telescopic and thus comprise an extendable portion that can be either retracted inside the main portion of the handle or fastened in an extended position. Advantageously, the handle can also be designed so as to be retracted through an opening provided in the rear portion of the blade of the shovel. This allows easy and compact storage.

BRIEF DESCRIPTION OF THE DRAWINGS

The invention will be better understood upon reading the following non-restrictive description of two preferred embodiments thereof, made with reference to the accompanying drawings.

FIG. 4 is a cross-sectional view taken along line IV—IV of FIG. 2.

FIG. 5 is a top plan view of the flexible portion of the shovel shown in FIG. 1.

FIG. 6 is a side elevational view of the same flexible portion as shown in FIG. 5.

FIG. 7 is a view similar to the one of FIG. 6, showing the flexible portion flexed to a certain extent.

FIG. 8 is a cross-sectional view similar to the one of FIG. 4, showing a flexible portion where the fins are slightly above the central axis.

DESCRIPTION OF THREE PREFERRED EMBODIMENTS

Figure 1:
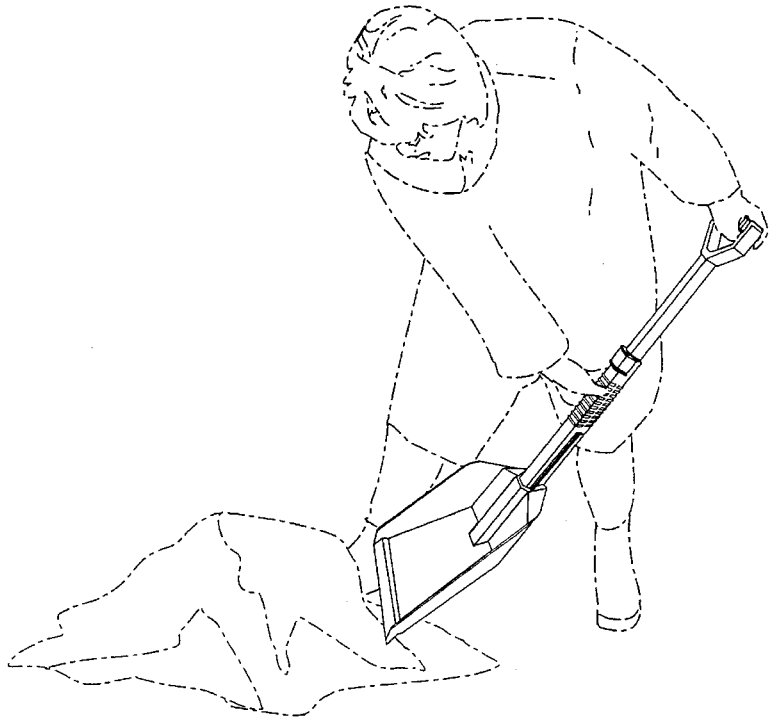
FIG. 1 is a perspective view of a shovel according to a first embodiment of the invention, in use.
Figure 2:
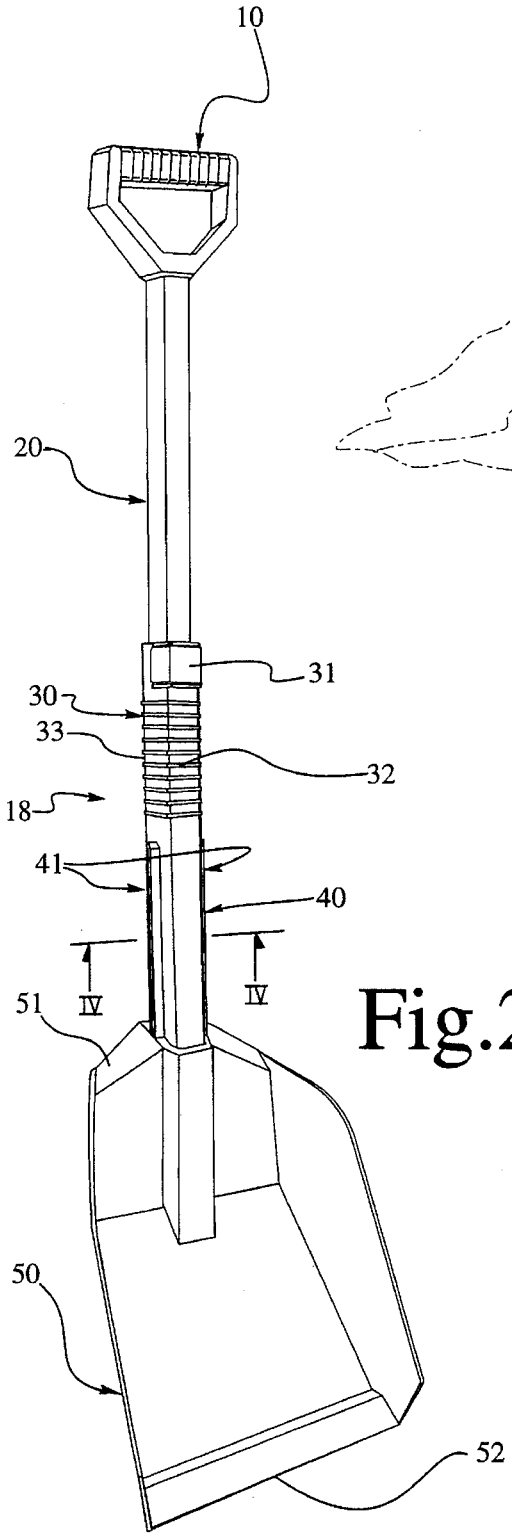
FIG. 2 is another perspective view of the same embodiment as in FIG. 1, in fully extended position.
Figure 3:
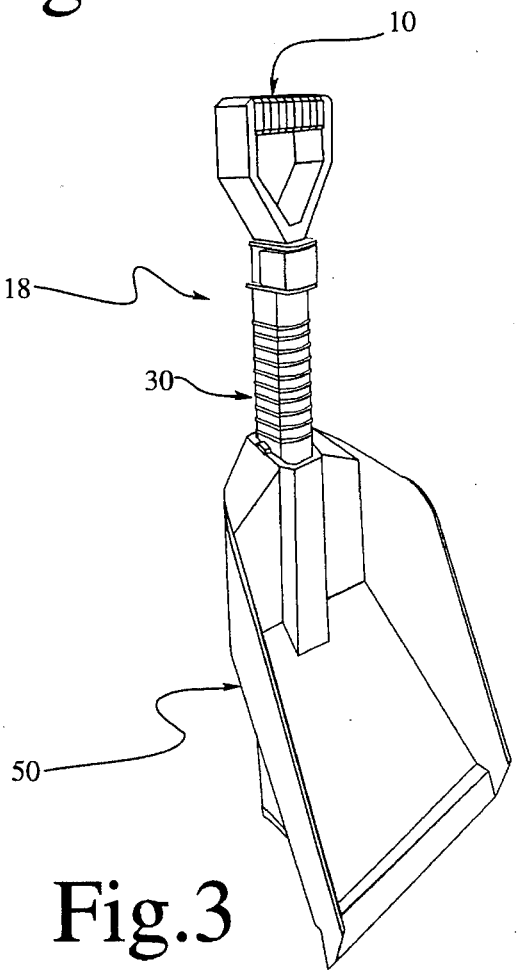
FIG. 3 is a view similar to the one of FIG. 2, showing the shovel in retracted position.
Figure 9:
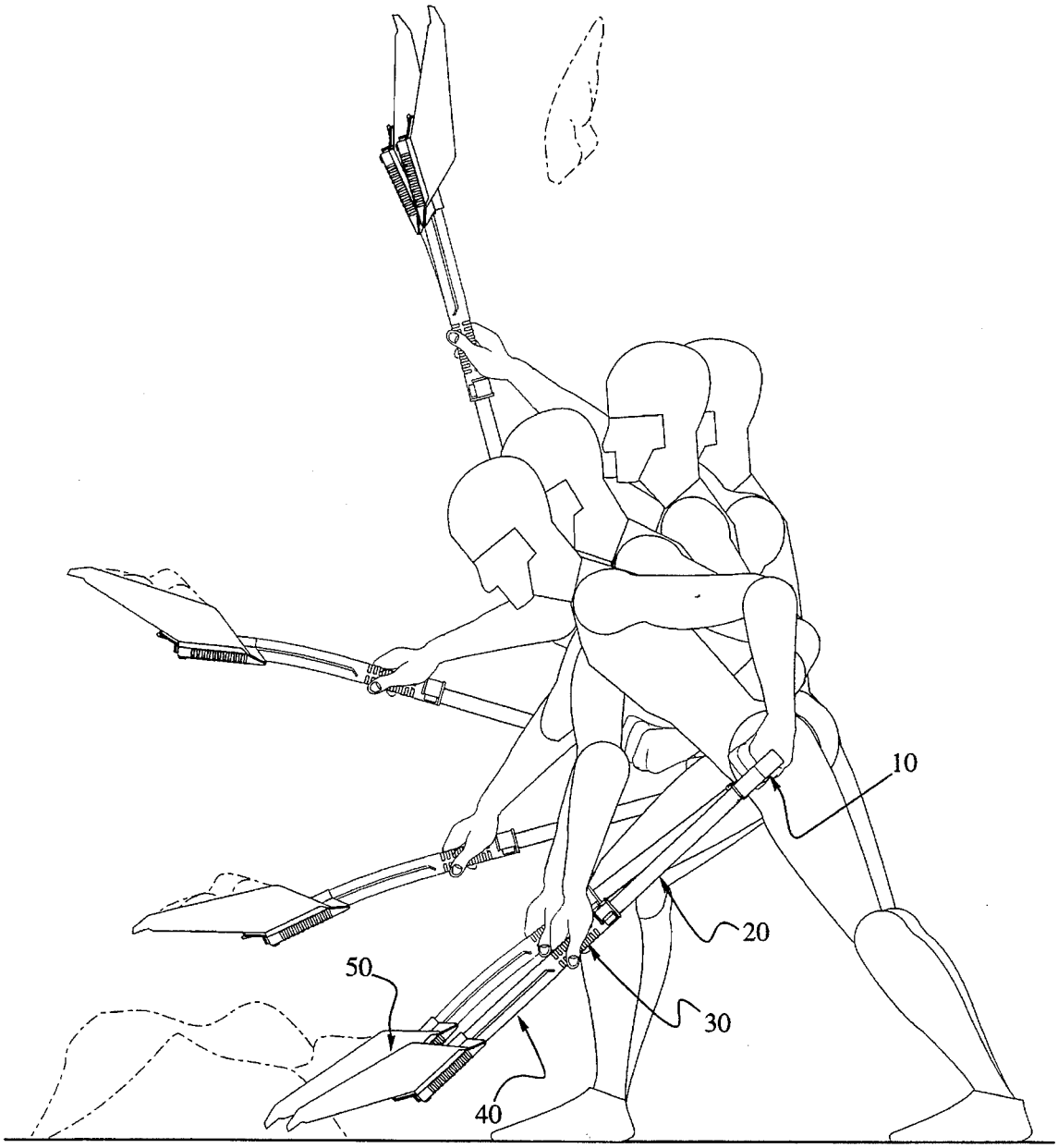
FIG. 9 is a side elevational view showing the shovel of FIGS. 1 to 3 in use, where the flexion of the flexible portion of the handle of this shovel is emphasized during a shovelling motion.
Figure 10:
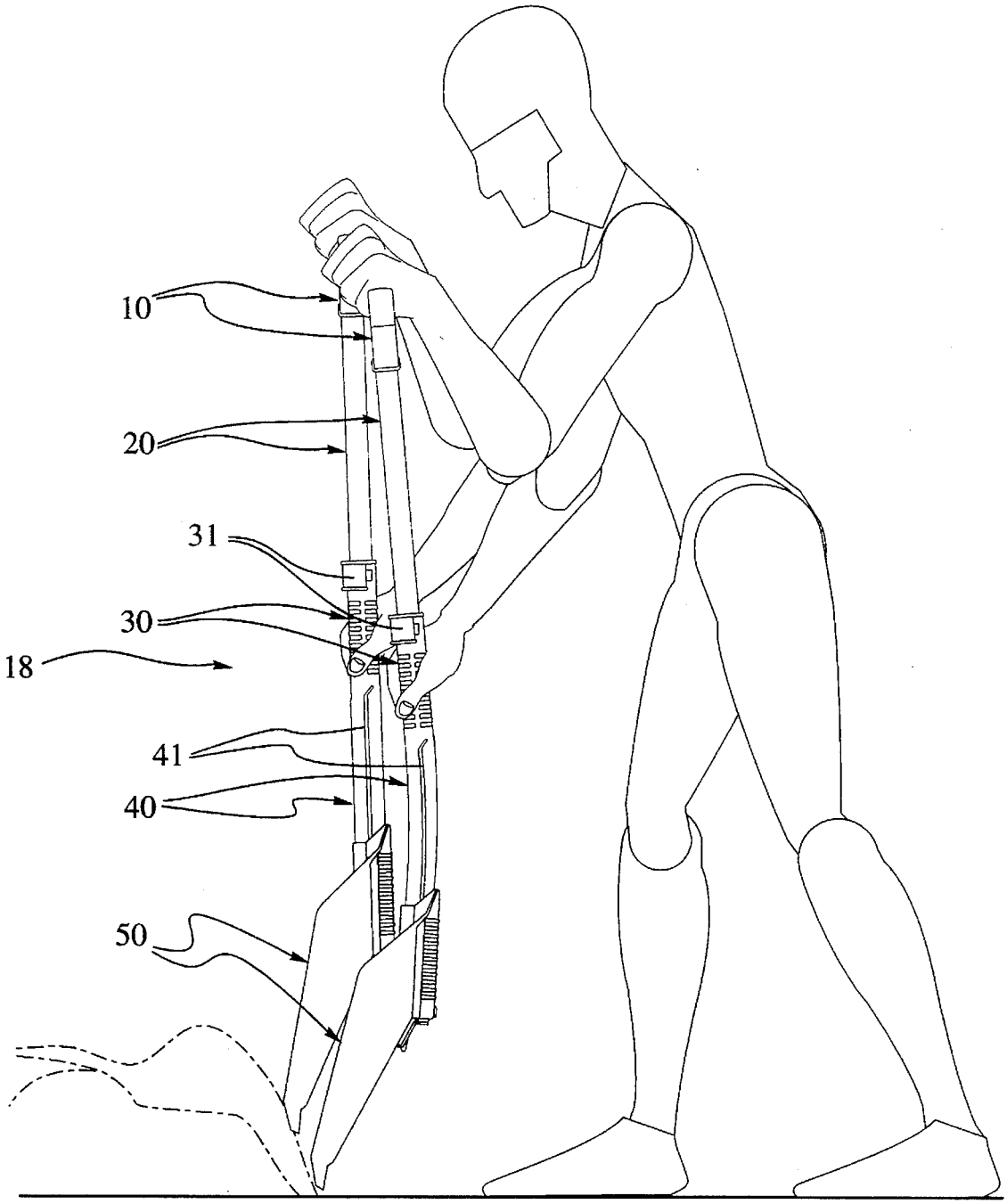
FIG. 10 is a side elevational view similar to the one of FIG. 9, where the flexion of the flexible portion is emphasized during a digging motion.
Figure 11:
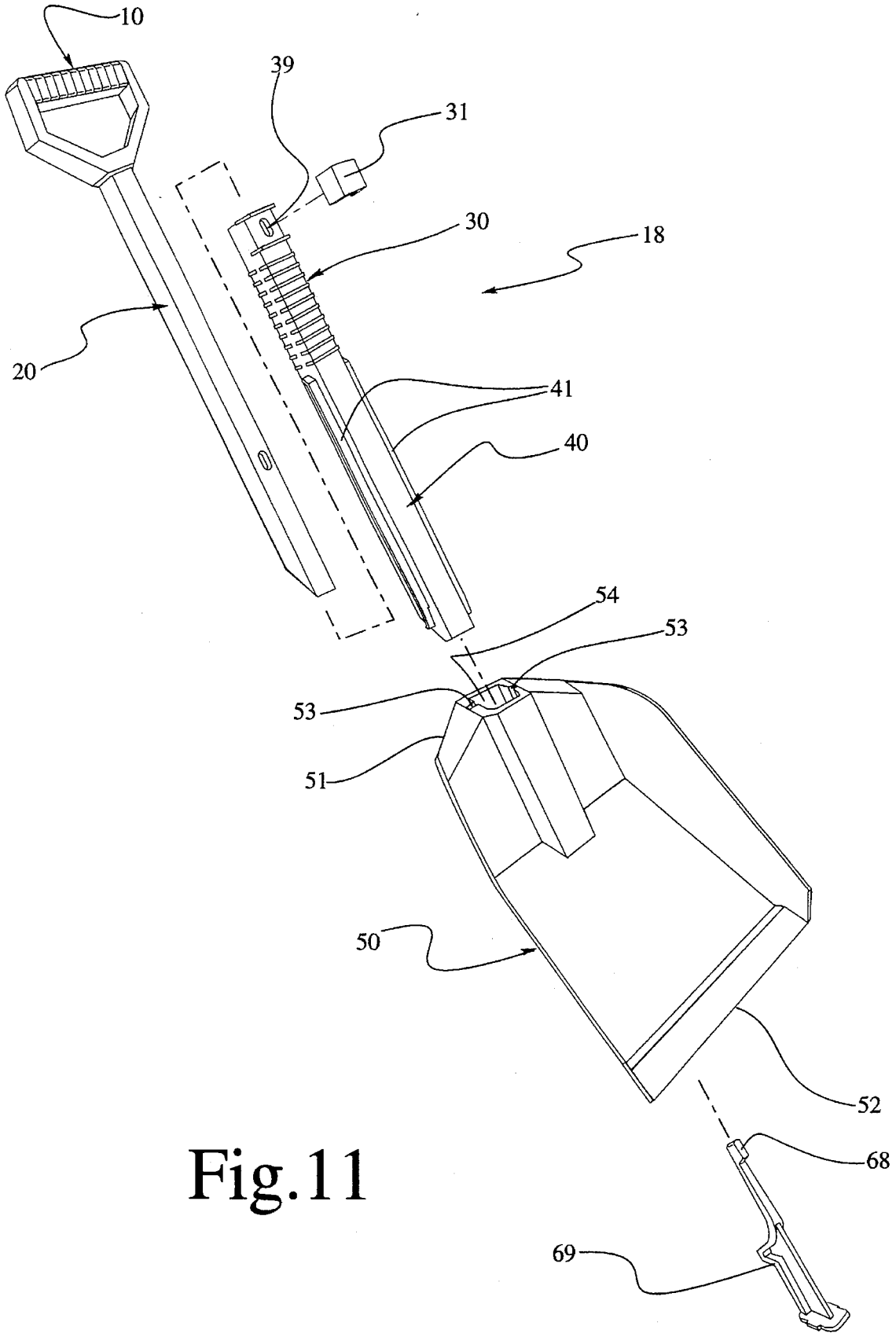
FIG. 11 is an exploded perspective view of the shovel shown in the previous drawings.
Figure 12A:
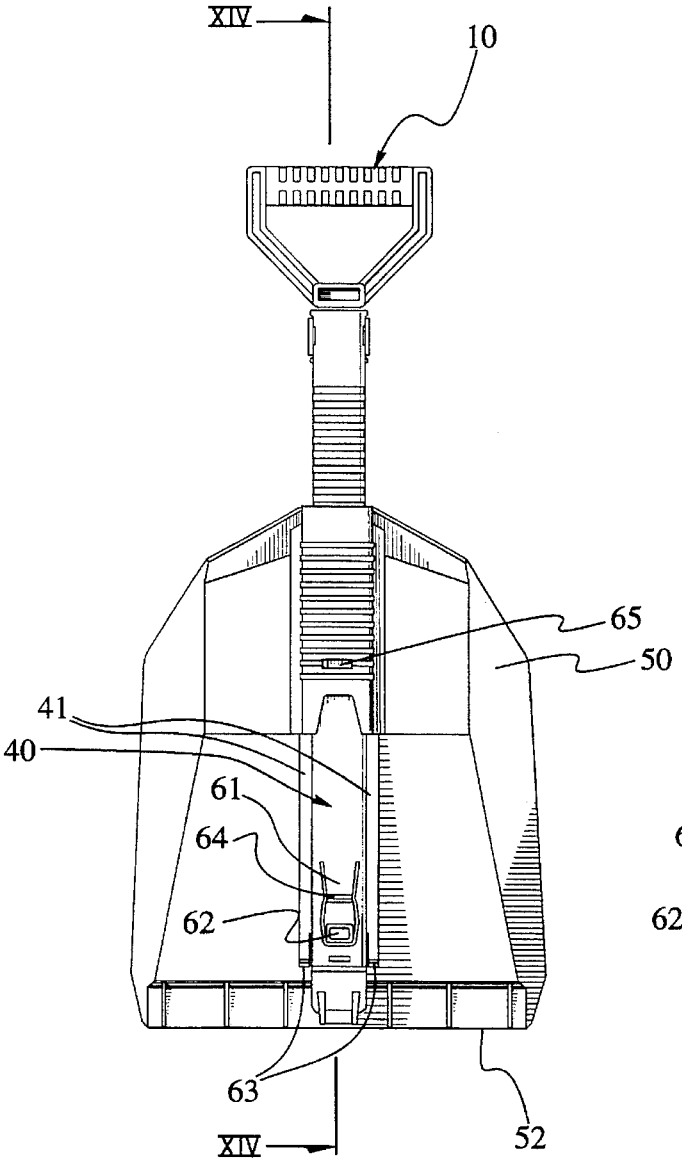
FIGS. 12*a* and 12*b* are rear and side elevational views of the shovel previously shown, in retracted position.
Figure 12B:
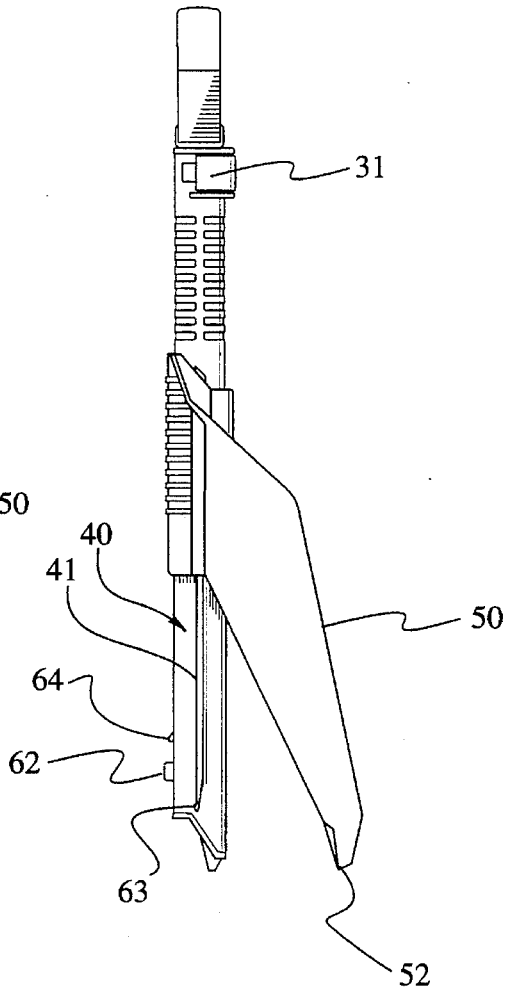
Figure 13A:
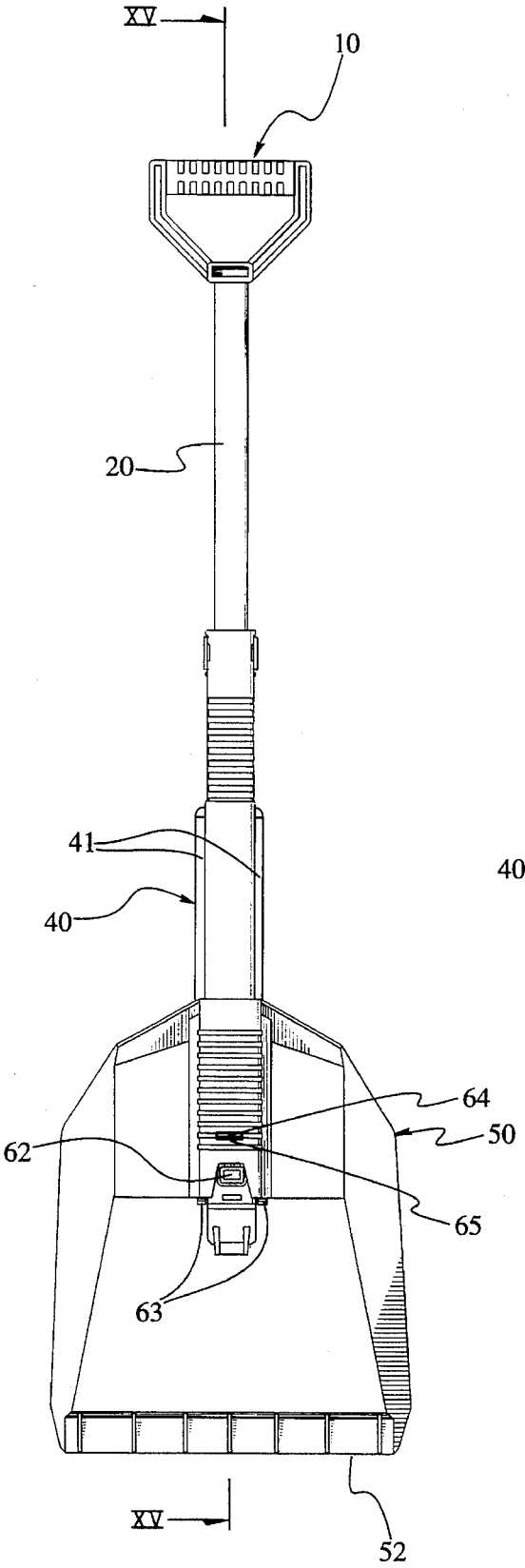
FIGS. 13*a* and 13*b* are rear and side elevational views of the shovel previously shown, in fully extended position.
Figure 13B:
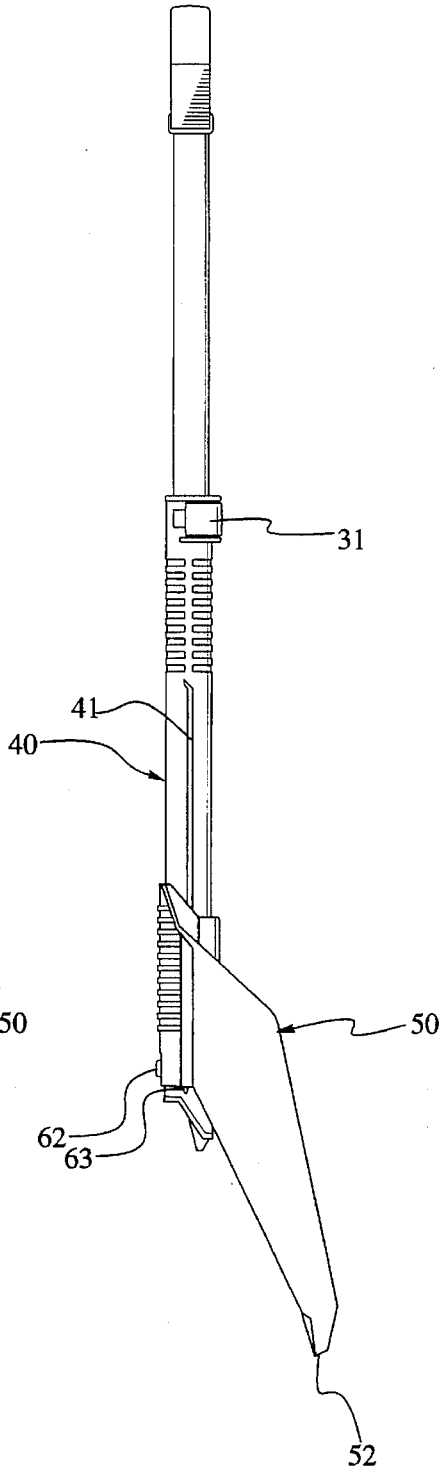
Figure 14:
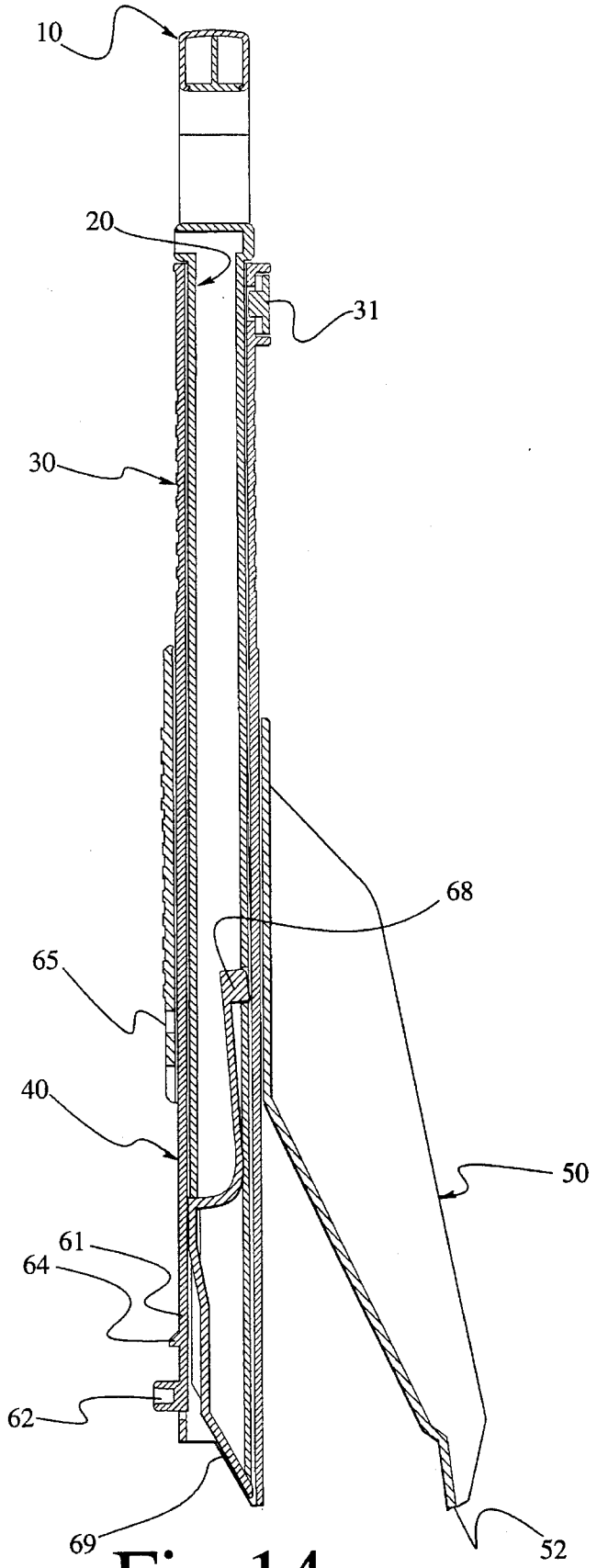
FIG. 14 is a cross-sectional view taken along line XIV—XIV in FIG. 12*a*.
Figure 15:
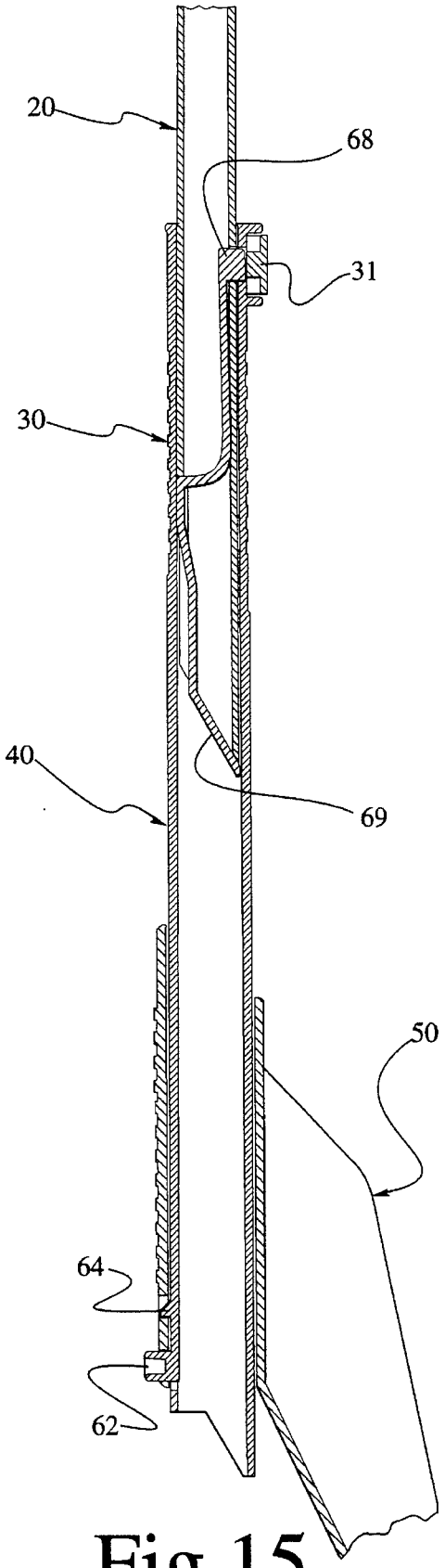
FIG. 15 is a cross-sectional view taken along line XV—XV in FIG. 13*a*.
Figure 16:
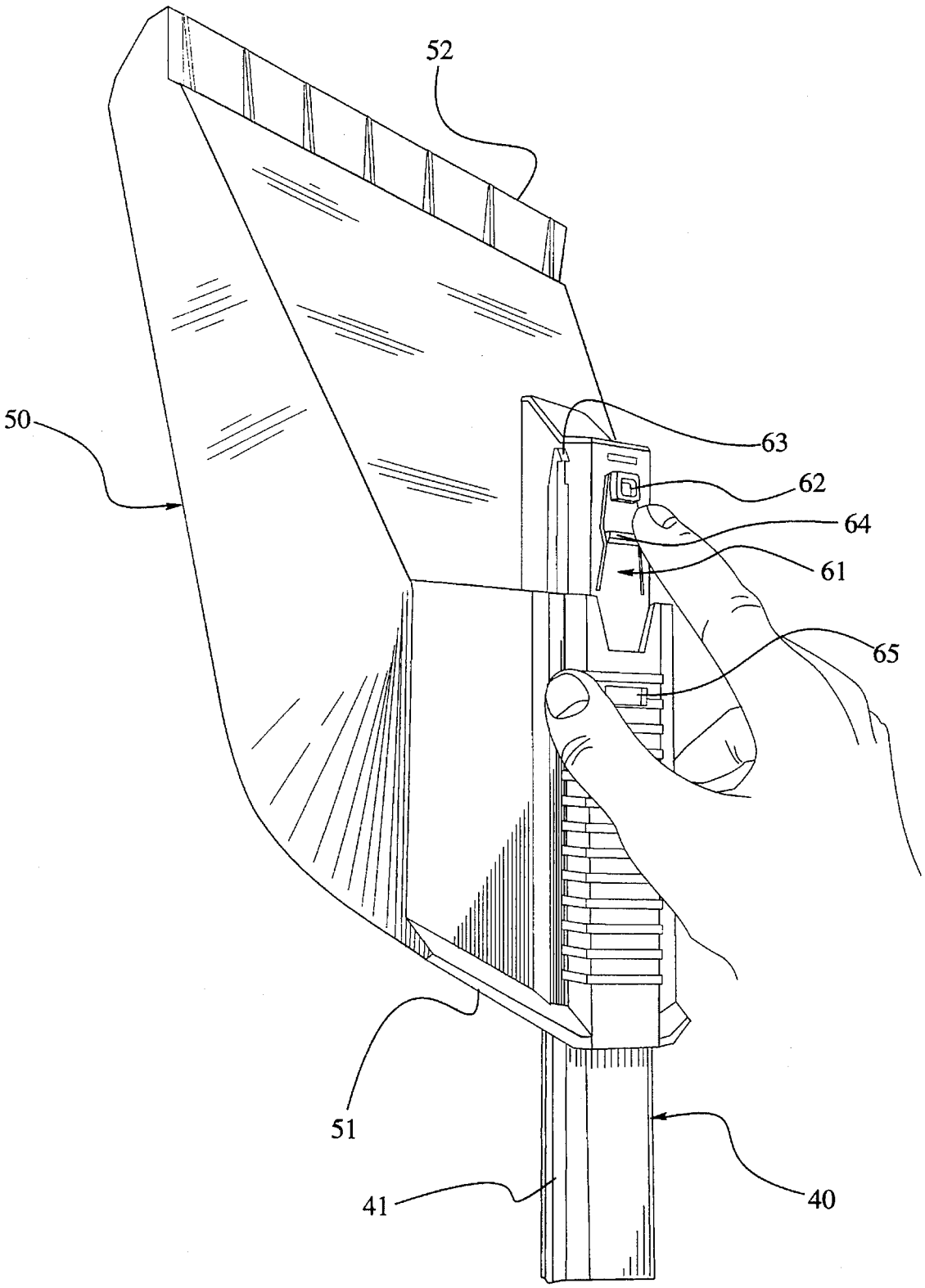
FIG. 16 is a partial perspective view of the rear portion of the blade of the embodiment shown in the previous figures.
Figure 17:
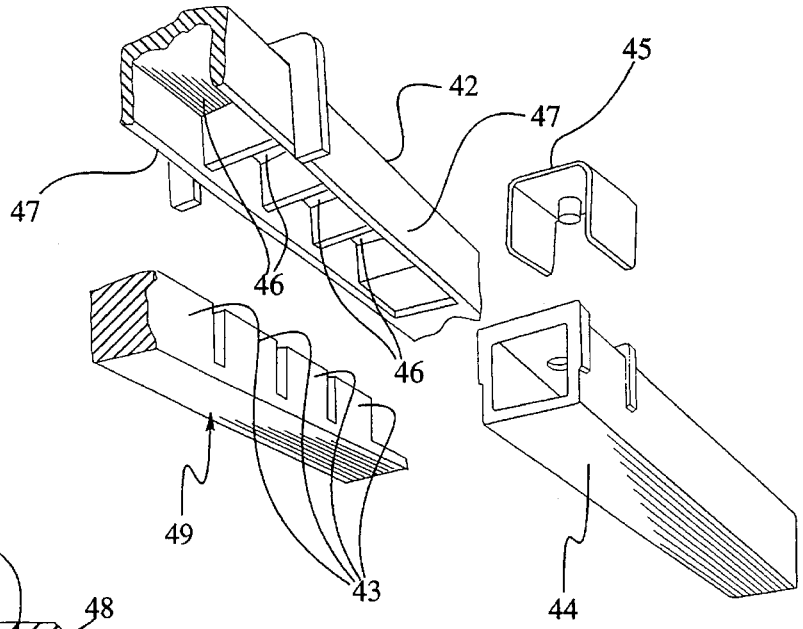
FIG. 17 is an exploded perspective view of the flexible portion of the handle of a shovel according to another embodiment of the invention.
Figure 22:
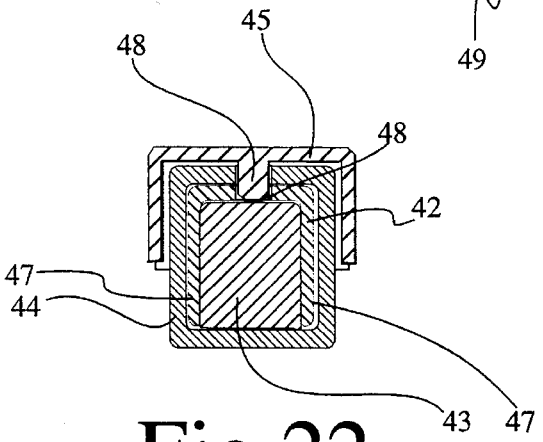
FIG. 22 is a cross-sectional view taken along the line XXII—XXII of FIG. 19.

In the following description and drawings, the same reference numerals will be used to identify the same structural components.

The shovel according to the invention as shown in the accompanying drawings comprises three main parts, namely a hand grip 10, a handle 18 and a blade 50.

The blade 50 has a front edge 52 and a rear portion 51 designed to receive the handle 18 and be connected to the same. The blade 50 is made of a single piece of plastic material. Alternatively, it can be made of metal.

The handle 18 has a front surface 32 and a back surface 33.

The handle 18 is preferably telescopic and comprises an extendable portion 20 which is telescopically mounted within a main portion 30. Specifically, the extendable portion 20 can be reversibly moved between a position where the extendable portion 20 is retracted inside the main portion 30 and a position where the extendable portion 20 is fully extended. The extendable portion 20 can be fastened in the fully extended position by means of snap lock consisting of a piece of resilient plastic material 69 inserted into the base of the extendable portion 20. This piece of resilient plastic material 69 has a pin 68 which projects towards the front surface 32 of the handle 18 in order to snap into a hole 39 drilled into the main portion 30. The tongue 68 can be released by a collar 31, similar to the one disclosed in Canadian Patent 1,277,462 and U.S. Pat. No. 4,908,900, so that the extendable portion 20 can be slidably retracted inside the main portion of the handle.

In accordance with an essential aspect of the invention, the handle 18 has a portion 40 adjacent to the blade 50 which is made flexible so as to permit flexion of the handle 18 to a given extent, exclusively in a plane perpendicular to the front edge 52 of the blade 50.

In a first embodiment of the invention shown in FIGS. 1 to 16, this flexible portion 40 is preferably made of hollow plastic material, having fins 41 extending longitudinally along it so as to permit flexion exclusively in a plane perpendicular to the front edge 52 of the blade 50.

In this particular embodiment, the shovel can be made even more compact. Thus, the rear portion 51 of the blade 50 may have an opening 54 having guard rails 53 such that the flexible portion 40 can be inserted in the opening 54 and the fins 41 fit inside the guard rails 53. This permits reversible movement of the flexible portion 40 between a position where the flexible portion 40 is partially retracted inside the blade 50 and a position where the flexible portion 40 is fully extended. The flexible portion 40 can be fastened in the fully extended position by means of another snap lock mechanism which comprises a rectangular opening 65 at the base of the rear portion 51 of the blade, and a tongue 61 having a protuberance 64. The protuberance 64 locks into the rectangular opening 65 when the flexible portion 40 is extended. The mechanism can be released by a push button 62, which clears the protuberance 64 from the rectangular opening 65 so that the flexible portion 40 can be retracted. The flexible portion 40 is prevented from slipping off the blade 50 by a pair of hooks 63 at the base of the flexible portion 40.

The advantage of having the shovel telescopic is that it makes its storage easy and compact, particularly if the shovel is to be stored in a vehicle such as a car. In this connection, compare FIGS. 2 and 3.

Figure 23:
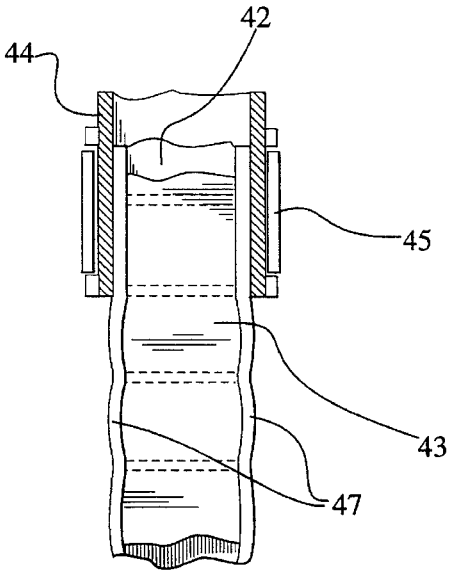
FIG. 23 is a bottom plan view of the flexible portion of the shovel shown in FIG. 17, in use.
Figure 21:
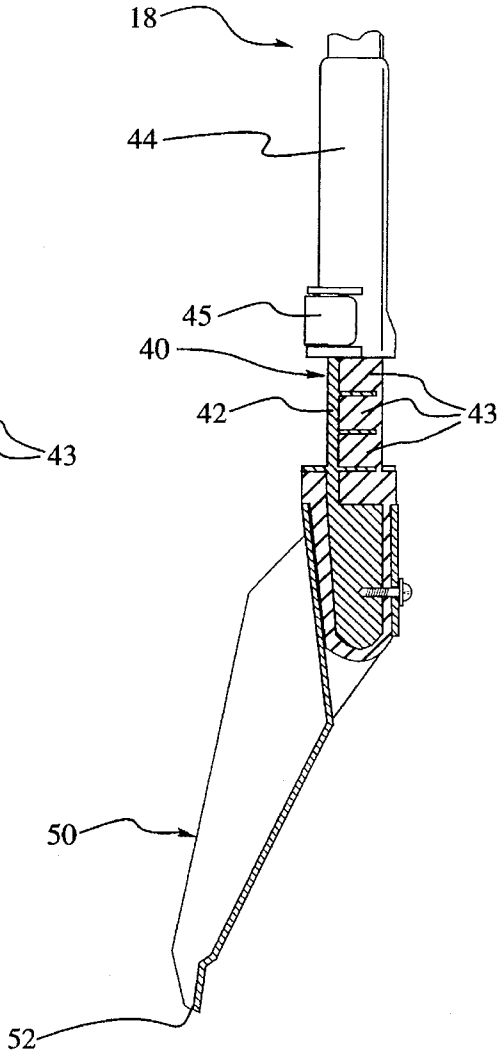
FIGS. 18, 19, 20 and 21 are side elevational views of the embodiment shown in FIG. 17, showing the lower part of the handle and the blade.
Figure 20:
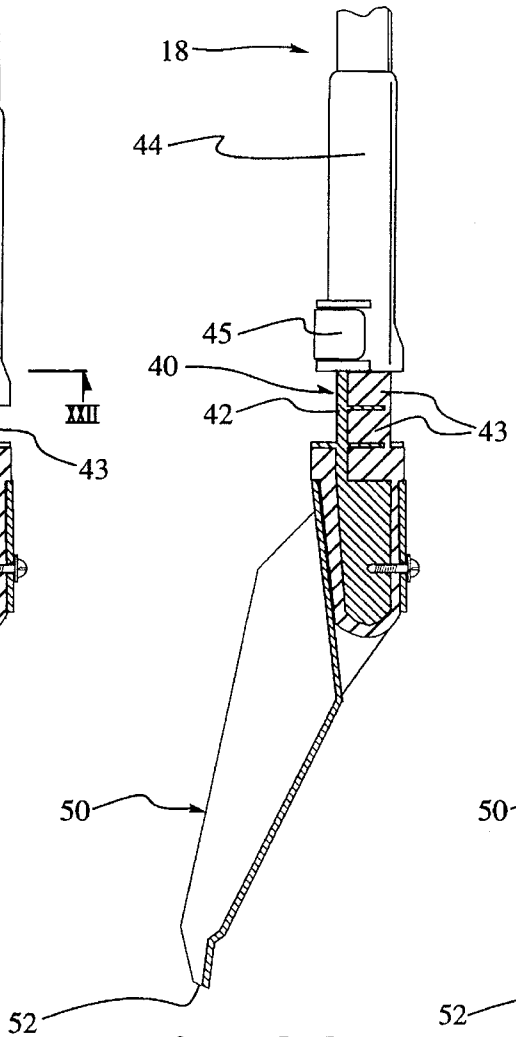
Figure 19:
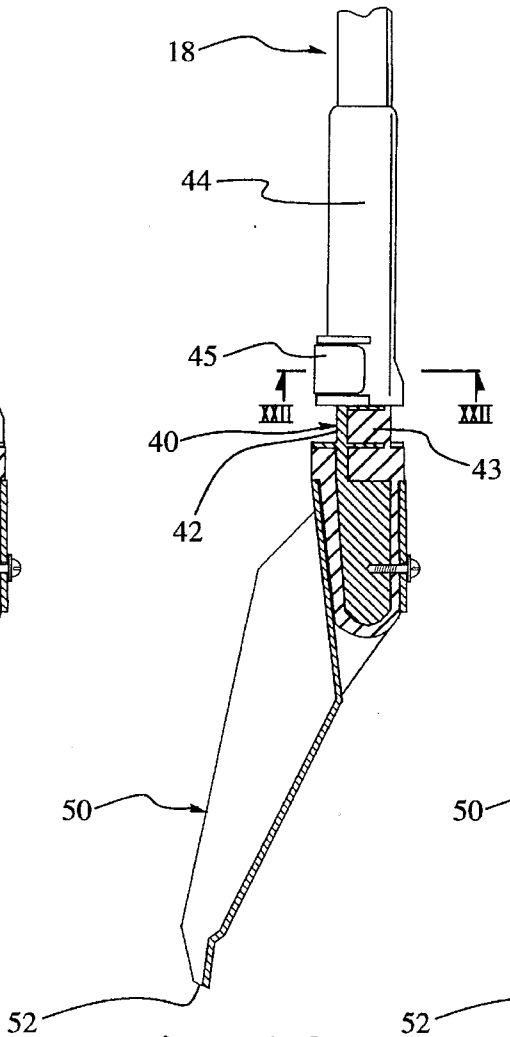
Figure 18:
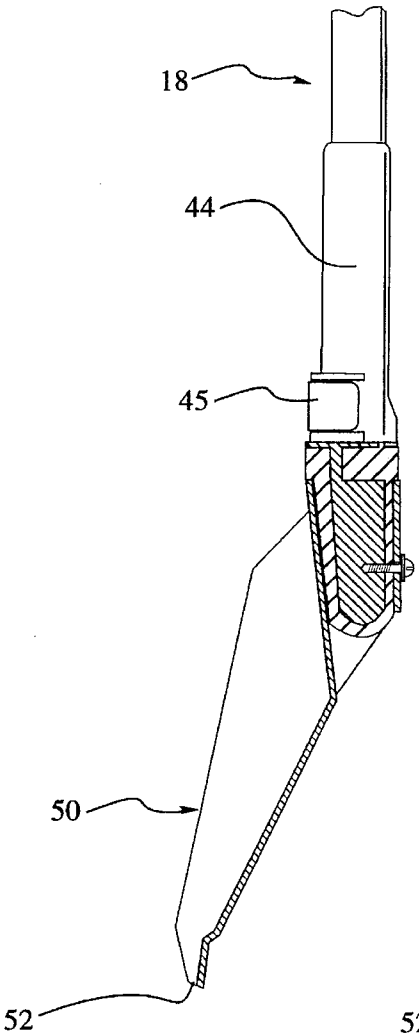

In a second embodiment of the invention shown in FIGS. 17 to 23, the flexible portion 40 comprises a piece of resilient plastic material 42 having transverse recesses 46 of given width at equal distances along the length of the piece of resilient plastic material 42, opening on the back surface 33 of the handle 18. Sections of elastomer 43 are fastened within all the recesses 46. Preferably, these sections of elastomer are made in a single piece 49 which is fastened to the piece of resilient plastic material 42. The flexible portion 40 is fastened to the blade 50 at one end and fastened to said handle 18 at the other end. The piece of resilient plastic material lies in the same plane as the front edge 52 of the blade 50 and at the front surface of the shovel so as to permit the elastomer 43 to compress and the lateral walls 47 to distort slightly, as can be seen in FIG. 23, when in use.

The flexible portion 40 of the second embodiment described above may also include a sleeve 44 for use to adjust the amount of resiliency of the portion 40. As can be seen in FIGS. 18, 19, 20 and 21, the sleeve 44 is fastened along the piece of flexible plastic material 42 by snapping a push button 45 inside holes 48 drilled at predetermined distances in the piece of flexible plastic material 42 on the front surface 32 of the handle.

When all recesses are covered by the sleeve 44, the flexible portion 40 exhibits no resiliency and when all the recesses are uncovered by the sleeve 44, the shovel exhibits maximum resiliency. Thus the user can adjust the resiliency of the flexible portion 40 so that it absorbs as little or as much as he or she desires.

Although the present invention has been described hereinabove by means of a preferred embodiment thereof, it should be pointed out that any modification to these preferred embodiments, within the scope of the appended claims, is not deemed to change or alter the nature of the invention.

Figure 24:
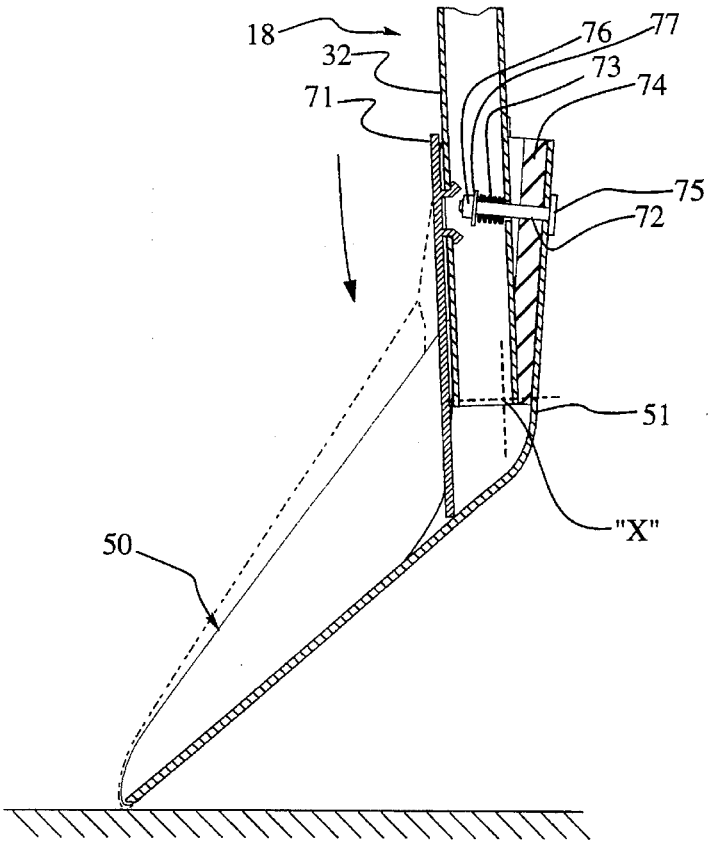
FIGS. 24 and 25 are side elevational cross-sectional views of another embodiment of the invention, showing the junction between the blade and the handle where the rotational aspect of the junction is enhanced during a digging and lifting motion.
Figure 25:
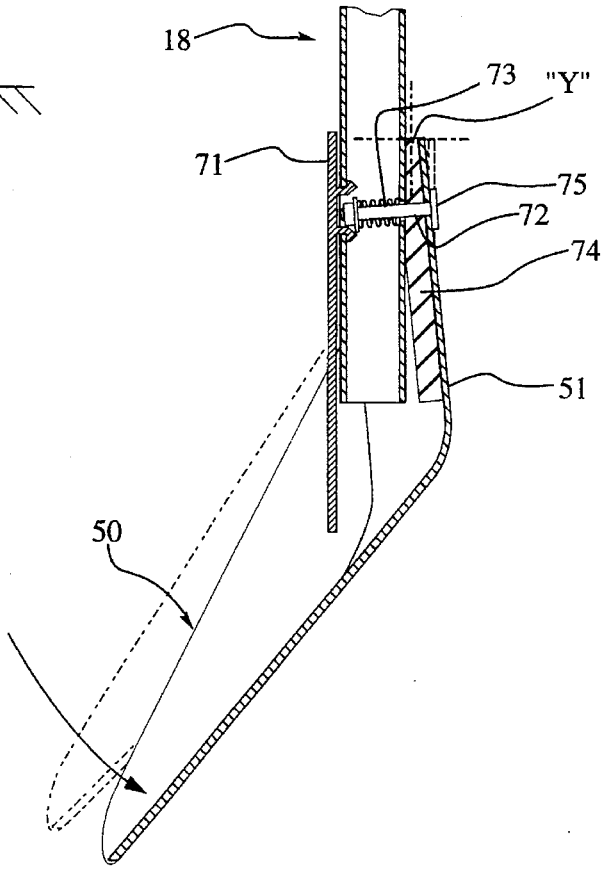

Thus, for example, the flexibility of the shovel could be obtained, as shown in FIGS. 24 and 25, by replacing the flexible portion of the handle with a rotating mechanism consisting of a spring 73 mounted around a pin 72 extending inside the handle 18. The pin 72 is inserted through the rear portion 51 of the blade 50 and is prevented from slipping inside the handle 18 by a head or nut 75. At the other end, a nut 76 and washer 77 prevent the spring 63 from slipping off the pin 72. The spring 73 is designed so that it extends inside the handle exclusively and its natural resiliency holds the pin firmly in place. Inserted between the handle 18 and the rear portion 51 of the blade 50 is a piece of elastomer 74. A cover 71, preferably made of plastic, is snapped on the front surface 32 of the handle to hide the mechanism.

When the user uses the shovel in a digging motion, the blade is forced to rotate clockwise in a limited manner about a first axis "X" which is downwardly spaced from the pin 72. This in turn forces the spring 73 to compress and thus absorb part of the impact, as shown in FIG. 24. Afterwards, when the user uses the shovel in a shovelling motion, lifting the load forces the blade 50 to rotate counter-clockwisely in a limited manner about a second axis "Y" which is upwardly spaced apart from the pin 72, thereby compressing the piece of elastomer, as shown in FIG. 25.

Instead of using such a mechanism, the flexibility of the shovel could be obtained by pivotably fastening the handle to the blade by means of a pin transversely inserted through the rear portion of the blade and the handle, where the rear portion is shaped like an open wedge. The pin would be fastened at both ends to the rear portion of the blade. A coil spring would then be mounted around the pin between the rear portion of the blade and the handle, and fastened at one end to the rear portion of the blade arid at the other end to the handle. The spring has a given resiliency so that when the user digs or shovels, the spring would absorb part of the initial shock or load and then return the blade to its static position.

I claim:

1. A shovel comprising:

a blade having a front edge and a rear portion;

a handle having a front surface, a back surface and two opposite ends, one of said ends being fastened to the rear portion of said blade, said handle having a portion adjacent to said one end which is made flexible so as to permit flexion of said handle to a given extent exclusively in a plane perpendicular to said front edge of said blade;

wherein said portion of the handle that is flexible consists of a hollow piece of plastic material of given resiliency, having two opposite ends and two opposite sides, each of said sides having a fin extending longitudinally along said portion so as to permit flexion exclusively a plane perpendicular to said front edge of said blade, one of said ends of said hollow piece being fastened to said handle, the other one of said ends of said hollow piece being fastened to said rear portion of said blade;

whereby, in use, when a user lifts a load with a given force and said load is greater than anticipated, said flexible portion will permit the user to adjust the force required to lift said load, thereby permitting said user to adjust smoothly to a new load and help prevent the risk of injury when lifting a load of unknown weight.

2. A shovel according to claim 1, wherein said handle is telescopic.

3. A shovel according to claim 1 wherein:

said blade is made of one piece of plastic material;

said rear portion of said blade has an opening with guard rails designed to accomodate said handle; and fixation means are provided for fastening said handle in a fully extended position, so as to allow reversible movement of said handle between a position where said handle is partially retracted inside said blade and a position where said portion is fully extended.

4. A shovel according to claim 3, wherein said fixation means comprises a push button on said handle and a snap lock mechanism, whereby when said handle is partially retracted behind said blade and is then slidably extended, said snap lock fastens said handle in an extended position and can subsequently be released by pressing said push button.

5. A shovel according to claim 4, wherein said handle is telescopic and comprises a main portion and an extendable portion each having opposite ends, one of the opposite ends of said extendable portion being slidably mounted inside said main portion so as to allow reversible movement of said extendable portion between a position where said extendable portion is inside said main portion and a position where said extendable portion is fully extended, said main portion also comprising means for retaining said extendable portion in said fully extended position.

6. A shovel according to claim 5, wherein said retaining means comprises a push button on said extendable portion and another snap lock mechanism, whereby when said extendable portion is fully retracted and is slidably extended, said another snap lock mechanism fastens said extendable portion in a fully extended position and can subsequently be released by pressing said button.

7. A shovel according to claim 6 wherein said handle further comprises a hand grip fastened to the other end of said handle.

* * * * *